US007655854B1

(12) United States Patent
Wang

(10) Patent No.: US 7,655,854 B1
(45) Date of Patent: Feb. 2, 2010

(54) PEDAL SUPPORT FOR PERCUSSION INSTRUMENTS

(76) Inventor: Wei-Pin Wang, No. 63, Gong-an Rd., Houli Township, Taichung County (TW)

( * ) Notice: Subject to any disclaimer, the term of this patent is extended or adjusted under 35 U.S.C. 154(b) by 0 days.

(21) Appl. No.: 12/239,752

(22) Filed: Sep. 27, 2008

(51) Int. Cl.
*G10D 13/02* (2006.01)

(52) U.S. Cl. ..... 84/422.3; 84/421

(58) Field of Classification Search ..... 84/422.3, 84/421, 422.1, 422.2
See application file for complete search history.

(56) References Cited

U.S. PATENT DOCUMENTS 7,511,212 B1 * 3/2009 Chang ..... 84/422.3

* cited by examiner

*Primary Examiner*—Jianchun Qin
(74) *Attorney, Agent, or Firm*—Banger Shia

(57) ABSTRACT

A pedal support for percussion instruments comprises a frame including a perpendicularly door-shaped supporting portion and a horizontal mounting portion, the supporting portion being fixed on the mounting member and including two ends, each having a positioning hole formed thereon, the two positioning holes axially coupling with two L-shaped connecting members individually so that the connecting members allow to swing between a first position and a second position, and each of the connecting members including a retaining slot; and a U-shaped piece being pivotally connected to one end of the mounting portion, wherein as the connecting members are located at the first position, the connecting members and the frame are in a retracted status, as the connecting members are located at the second position, the retaining slots of the connecting members engage on the U-shaped piece.

7 Claims, 4 Drawing Sheets

PEDAL SUPPORT FOR PERCUSSION INSTRUMENTS

BACKGROUND OF THE INVENTION

1. Field of the Invention

The present invention relates to a pedal support for percussion instruments, and more particularly to a retractable pedal support for percussion instruments that can facilitate the positioning thereof.

2. Description of the Prior Art

Conventional pedal supports for percussion instruments are used to support the percussion instruments. In order to carry such conventional pedal supports easily, they are designed to be retractable, however, the pedal supports have to be positioned by using a plurality of screws, hence it is tedious to retract the conventional pedal supports.

The present invention has arisen to mitigate and/or obviate the afore-described disadvantages.

SUMMARY OF THE INVENTION

The primary objective of the present invention is to provide a pedal support for percussion instruments that can facilitate the positioning thereof.

To achieve the above-mentioned objectives, the pedal support for percussion instruments provided in accordance with the present invention comprises:

a frame including a perpendicularly door-shaped supporting portion and a horizontal mounting portion, the supporting portion being fixed on the mounting member and including two ends, each having a positioning hole formed thereon, the two positioning holes axially coupling with two L-shaped connecting members individually so that the connecting members allow to swing between a first position and a second position, and each of the connecting members including a retaining slot; and a U-shaped piece being pivotally connected to one end of the mounting portion, wherein as the connecting members are located at the first position, the connecting members and the frame are in a retracted status, as the connecting members are located at the second position, the retaining slots of the connecting members engage on the U-shaped piece.

DETAILED DESCRIPTION OF THE PREFERRED EMBODIMENT

The present invention will be clearer from the following description when viewed together with the accompanying drawings, which show, for purpose of illustrations only, the preferred embodiment in accordance with the present invention.

Figure 1:
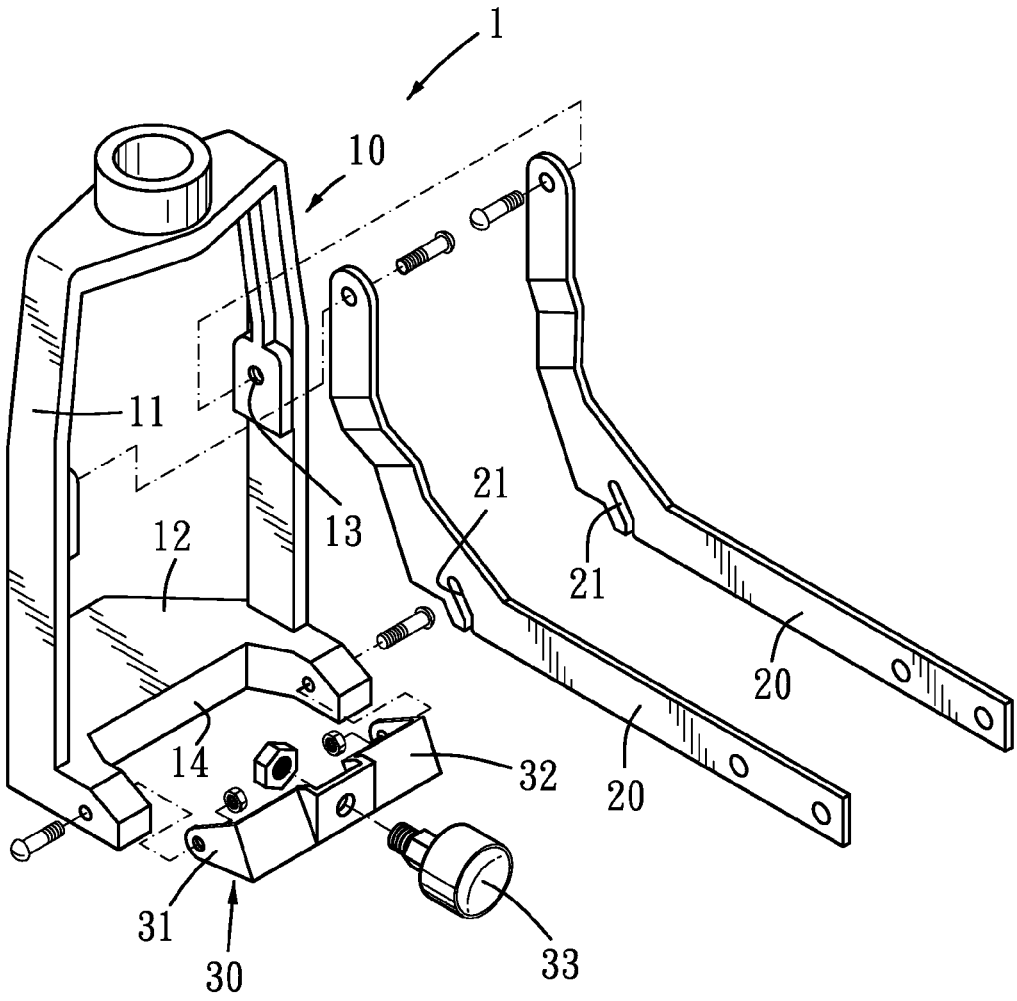
FIG. 1 is a perspective view illustrating the exploded components of a pedal support for percussion instruments according to the present invention.
Figure 2:
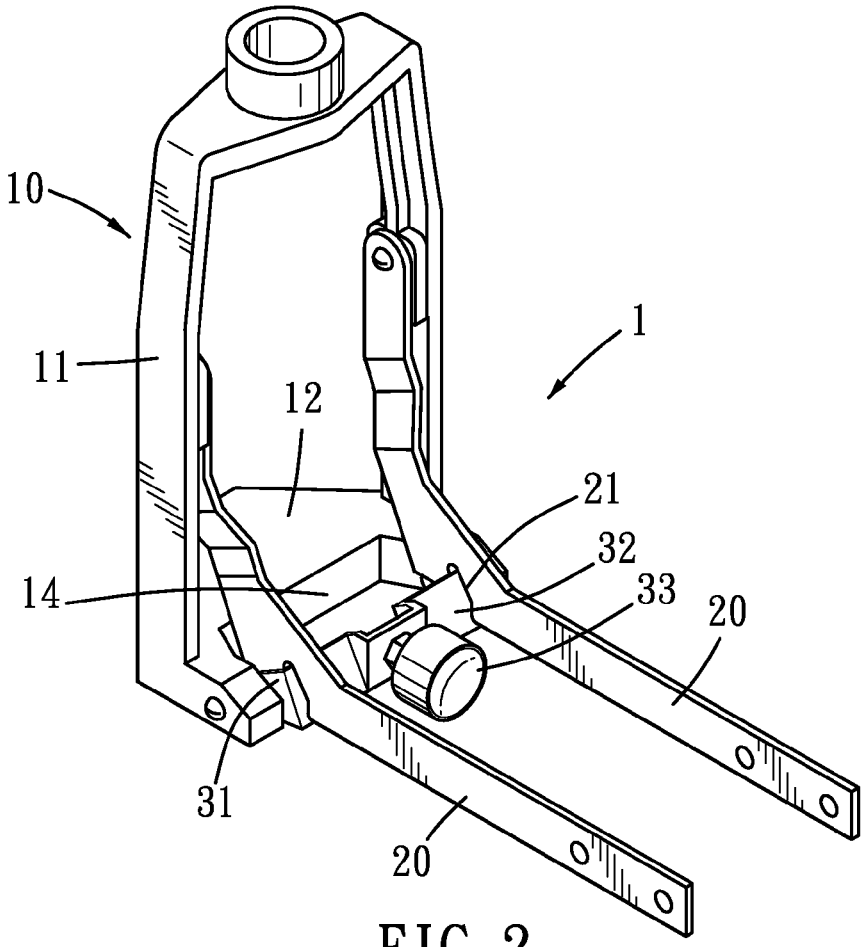
FIG. 2 is a perspective view illustrating the assembly of the pedal support for percussion instruments according to the present invention.
Figure 3:
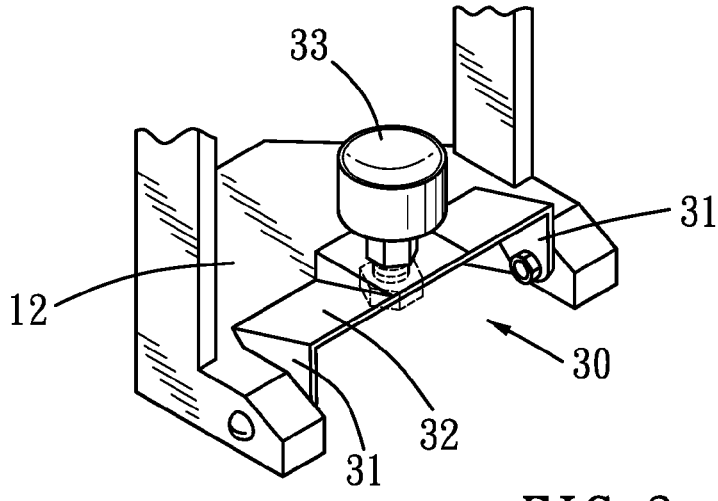
FIG. 3 is a perspective view illustrating a U-shaped piece of the pedal support for percussion instruments being in a swinging state.

Referring to FIGS. 1 to 3, a pedal support 1 for percussion instruments in accordance with the present invention comprises a frame 10, two L-shaped connecting members 20, and a U-shaped piece 30. The frame 10 includes a perpendicularly door-shaped supporting portion 11 and a horizontal mounting portion 12, the supporting portion 11 is fixed on the mounting member 12, and the supporting portion 11 includes two ends, each having a positioning hole 13 formed thereon, the positioning hole 13 is used to axially couple with one end of the connecting member 20 so that the connecting member 20 allows to swing between a first position and a second position.

Besides, each of the connecting members 20 includes a retaining slot 21, and the U-shaped piece 30 includes a connection portion 31 and an inlay portion 32, the connection portion 31 is located at the two ends of the U-shaped piece 30 and is pivotally connected on the inner side of a recess 14 at the front end of the mounting portion 12 such that the U-shaped piece 30 can be pivotally retracted in the recess 14. Furthermore, the inlay portion 32 is received and retained in the retaining slots 21 of the connecting members 20, and the inlay portion 32 tilts at a predetermined angle with respect to the ground, and it is preferred that the inlay portion 32 tilts toward the supporting portion 11 so that the connecting members 20 have a preferred fixing effect. The U-shaped piece 30 includes a ground contacting member 33 attached thereon, and one end of the ground contacting member 33 is formed in the shape of a cylinder, and another end thereof is screwed on the U-shaped piece 30 so that the ground contacting member 33 permits to be used as a handle. Moreover, the ground contacting member 33 can contact with the ground and support the U-shaped piece 30, the connecting members 20, and further auxiliarily support the entire percussion instruments.

Figure 4:
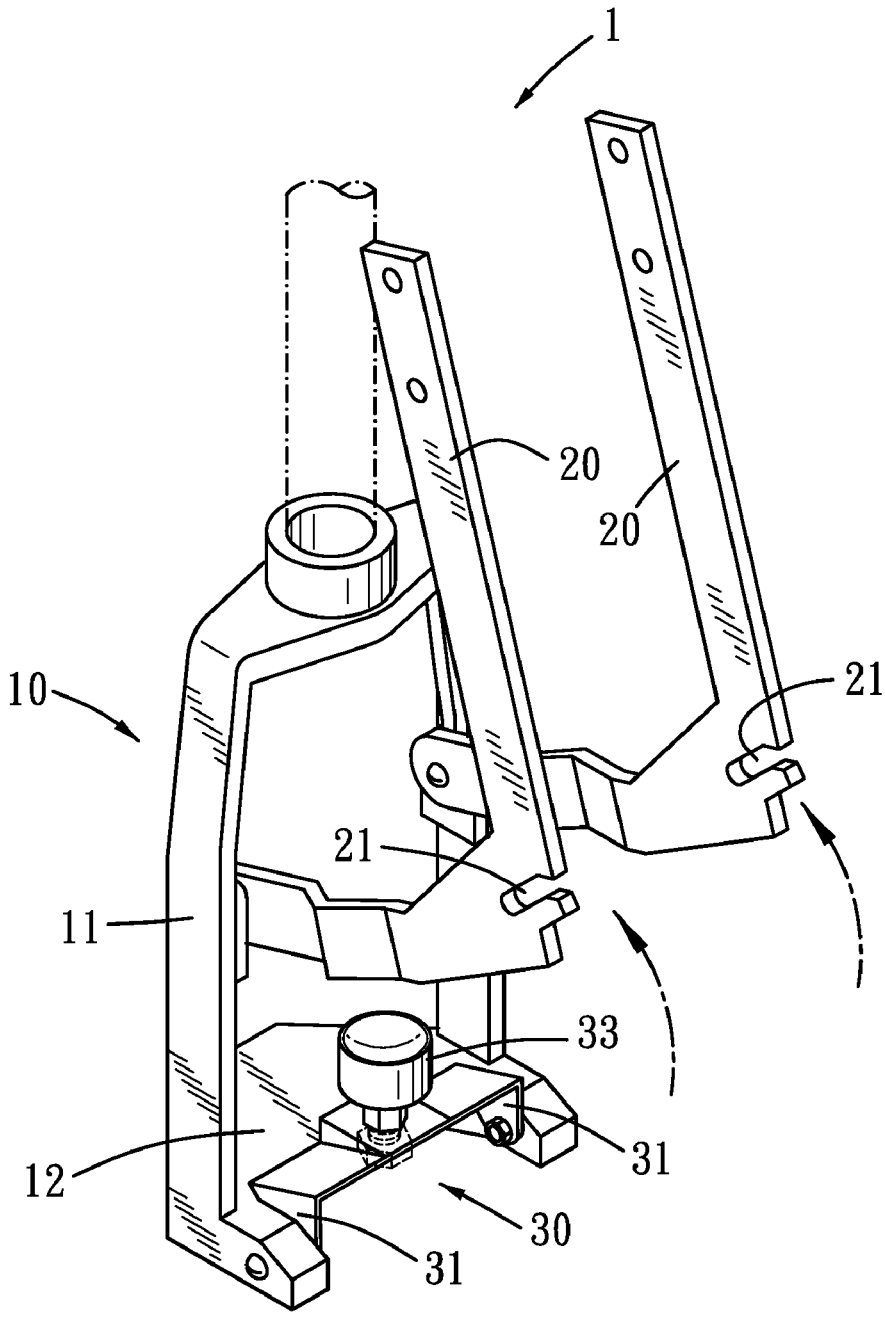
FIG. 4 is a perspective view illustrating two connecting members of the pedal support for percussion instruments being located at a first position.
Figure 5:
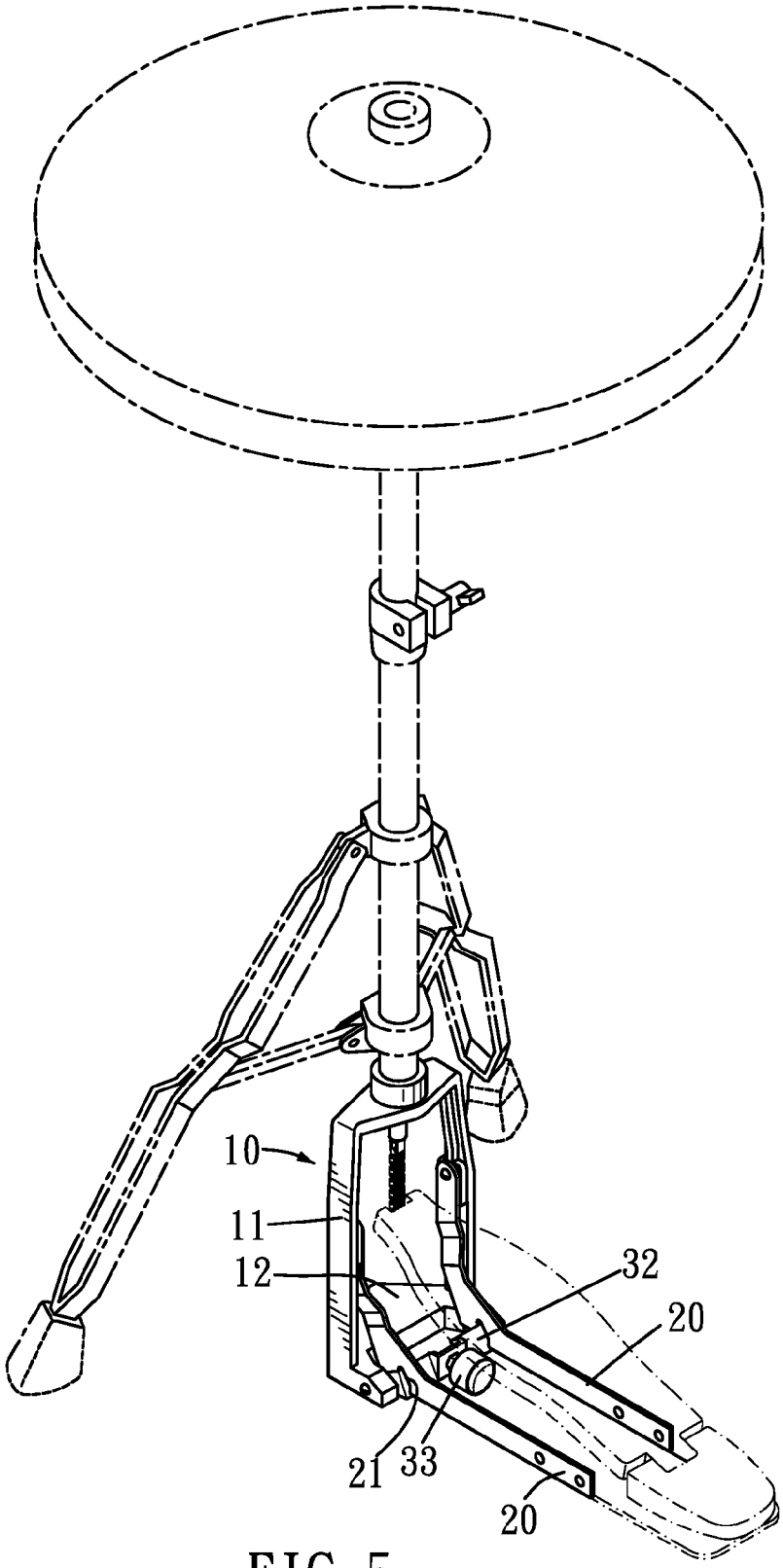
FIG. 5 is a perspective view illustrating the two connecting members of the pedal support for percussion instruments being located at a second position.

Referring further to FIG. 4, as the connecting members 20 are located at the first position, the retaining slots 21 separate from the inlay portion 32, accordingly the connecting members 20 and the frame 10 are in a retracted status. As shown in FIG. 5, as the connecting members 20 are located at the second position, the retaining slots 21 engage on the inlay portion 32 of the U-shaped piece 30, in the meantime, the inlay portion 32 becomes beveled at an angle relative to the ground, and the ground contacting member 33 contacts with the ground.

It can be clearly seen from the preceding accounts on the features of the present invention that as desiring to position the connecting members, the inlay portion is engaged in the retaining slots of the connecting members, therefore the user can manually finish the positioning of the pedal support without using any tools. Furthermore, the U-shaped piece can be pivotally connected with the mounting portion so as to be pivotally retracted, thus facilitating the positioning of the pedal support for the percussion instruments.

While we have shown and described various embodiments in accordance with the present invention, it is clear to those skilled in the art that further embodiments may be made without departing from the scope of the present invention.

What is claimed is:

1. A pedal support for percussion instruments comprising:

a frame, the frame including a perpendicularly door-shaped supporting portion and a horizontal mounting portion, the supporting portion being fixed on the mounting member and including two ends, each having a positioning hole formed thereon, the two positioning holes axially coupling with two L-shaped connecting members individually, thereby the connecting members allow to swing between a first position and a second position, and each of the connecting members including a retaining slot; and a U-shaped piece being pivotally connected to one end of the mounting portion, wherein as the connecting members are located at the first position, the connecting members and the frame are in a retracted status, as the connecting members are located at the second position, the retaining slots of the connecting members engage on the U-shaped piece;

wherein the U-shaped piece includes a connection portion and an inlay portion, the connection portion is located at the two ends of the U-shaped piece and axially connected with the front end of the mounting member, and as the connecting members are located at the second position, the inlay portion tilts at a predetermined angle with respect to the ground and engages in the retaining slots.

2. The pedal support for percussion instruments as claimed in claim 1, wherein the U-shaped piece is pivotally disposed at the front end of the mounting portion.

3. The pedal support for percussion instruments as claimed in claim 2, wherein the U-shaped piece includes a ground contacting member attached thereon, as the connecting members are located at the second position and the retaining slots engage on the U-shaped piece, the ground contacting member contacts with the ground and supports the U-shaped piece.

4. The pedal support for percussion instruments as claimed in claim 1, wherein at one end of the mounting portion is formed a recess, and the connection portion of the U-shaped piece is pivotally connected on the inner side of the recess.

5. The pedal support for percussion instruments as claimed in claim 4, wherein the U-shaped piece includes a ground contacting member attached thereon, as the connecting members are located at the second position and the retaining slots engage on the U-shaped piece, the ground contacting member contacts with the ground and supports the U-shaped piece.

6. The pedal support for percussion instruments as claimed in claim 1, wherein the U-shaped piece includes a ground contacting member attached thereon, as the connecting members are located at the second position and the retaining slots engage on the U-shaped piece, the ground contacting member contacts with the ground and supports the U-shaped piece.

7. The pedal support for percussion instruments as claimed in claim 6, wherein one end of the ground contacting member is formed in the shape of a cylinder, and another end thereof is screwed on the U-shaped piece.

* * * * *